US007635205B2

(12) United States Patent
Yu et al.

(10) Patent No.: US 7,635,205 B2
(45) Date of Patent: Dec. 22, 2009

(54) LED LAMP WITH HEAT DISSIPATION DEVICE

(75) Inventors: Guang Yu, Shenzhen (CN); Shi-Song Zheng, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 27 days.

(21) Appl. No.: 11/782,453

(22) Filed: Jul. 24, 2007

(65) Prior Publication Data

US 2009/0027888 A1 Jan. 29, 2009

(51) Int. Cl.
*F21V 29/00* (2006.01)

(52) U.S. Cl. ..... 362/294; 362/373; 362/800

(58) Field of Classification Search ..... 362/294, 362/249, 555, 612, 545, 234, 373, 800, 345; 165/80.2, 80.3, 80.4; 361/274.2, 274.3, 676, 361/679.46, 679.47, 688, 697, 703, 711, 361/831

See application file for complete search history.

(56) References Cited

U.S. PATENT DOCUMENTS

| | | | | |
|---|---|---|---|---|
| 4,204,246 | A * | 5/1980 | Arii et al. | 361/699 |
| 4,729,076 | A * | 3/1988 | Masami et al. | 362/235 |
| 6,487,076 | B1 * | 11/2002 | Wang | 361/697 |
| 6,517,218 | B2 | 2/2003 | Hochstein | |
| 6,517,221 | B1 * | 2/2003 | Xie | 362/373 |
| 6,712,129 | B1 * | 3/2004 | Lee | 165/104.21 |
| 6,880,952 | B2 | 4/2005 | Kiraly et al. | |
| 6,880,956 | B2 * | 4/2005 | Zhang | 362/264 |
| 7,284,874 | B2 * | 10/2007 | Jeong et al. | 362/97 |
| 2004/0169451 | A1 * | 9/2004 | Oishi et al. | 313/45 |
| 2006/0262571 | A1 * | 11/2006 | Chen | 362/632 |

FOREIGN PATENT DOCUMENTS

TW M286565 1/2006

* cited by examiner

*Primary Examiner*—Gunyoung T Lee
(74) *Attorney, Agent, or Firm*—Frank R. Niranjan

(57) ABSTRACT

An LED lamp includes an LED module (12), two heat spreaders (31), two heat pipes (35) and two heat sinks (38). The LED module includes a plurality of LEDs (122). The heat spreaders are positioned under the LED module. The heat pipes are sandwiched between the heat spreaders and extend to lateral sides of the heat spreaders. The heat sinks are positioned beside the heat spreaders and engaged with the heat pipes.

6 Claims, 3 Drawing Sheets

LED LAMP WITH HEAT DISSIPATION DEVICE

BACKGROUND OF THE INVENTION

1. Field of the Invention

The present invention relates generally to a light emitting diode (LED) lamp, and more particularly to an LED lamp incorporating a heat dissipation device for improving heat dissipation of the LED lamp.

2. Description of Related Art

With the continuing development of scientific technology and the raise of people's consciousness of energy saving, LEDs have been widely used in the field of illumination due to their small size and high efficiency. It is well known that an LED lamp with high power consumption generates a lot of heat when it emits light, whereby the LEDs are arranged side-by-side in large density. If the heat cannot be quickly removed, the LED lamp may become overheated, significantly reducing work efficiency and service life.

A related method and device of solving the heat dissipation problem of an LED device is disclosed in U.S. Pat. No. 6,517,218. The LED device comprises a plurality of LEDs mounted on a circuit board. A heat dissipater is attached to a bottom of the circuit board. Heat generated by the LEDs is conducted to a plurality of cooling fins of the heat dissipater, and then dispersed into ambient air via the fins. However, the heat dissipater has a long length in a vertical direction, thus making the LED device difficult to fix in a structure, especially in a roof or a wall which has a limited room for the LED device.

What is needed, therefore, is an LED lamp which has a short length in a vertical direction and is convenient to be secured in different applications.

SUMMARY OF THE INVENTION

An LED lamp includes an LED module, two heat spreaders, two heat pipes and two heat sinks. The LED module includes a plurality of LEDs. The heat spreaders are positioned under the LED module. The heat pipes are sandwiched between the heat spreaders and extend to lateral sides of the heat spreaders. The heat sinks are positioned beside the heat spreaders and engaged with the heat pipes. A transparent lampshade receives the LED module therein. A plurality of screws extend through the lampshade, the printed circuit board, the heat spreader to threadedly engage in a support portion of the LED lamp, thereby completing the assembly of the LED lamp. The support portion can be used to mount the LED lamp to a structure, like a ceiling or a wall of a building.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
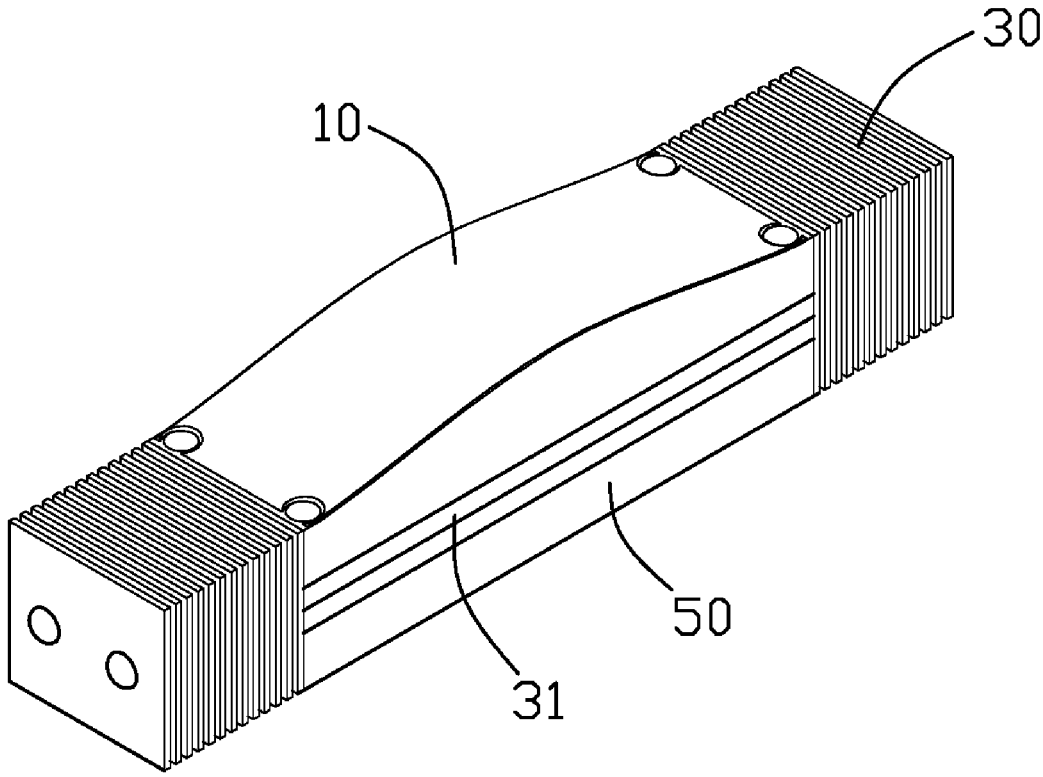
FIG. 1 is an assembled, isometric view of an LED lamp with a heat dissipation device in accordance with a preferred embodiment of the present invention.

Referring to FIG. 1, an LED lamp in accordance with a preferred embodiment of the present invention adapted for a lighting purpose is shown. The LED lamp comprises a light portion 10, a heat dissipation portion 30 and a support portion 50. The light portion 10 is used for emitting light. The heat dissipation portion 30 is used for dissipating heat generated from the light portion 10. The support portion 50 is used for supporting and engaging with the light portion 10 and the heat dissipation portion 30. Furthermore, the support portion 50 can also be used to secure the light portion 10 and the heat dissipation portion 30 to a structure like a ceiling or a wall of a building.

Figure 2:
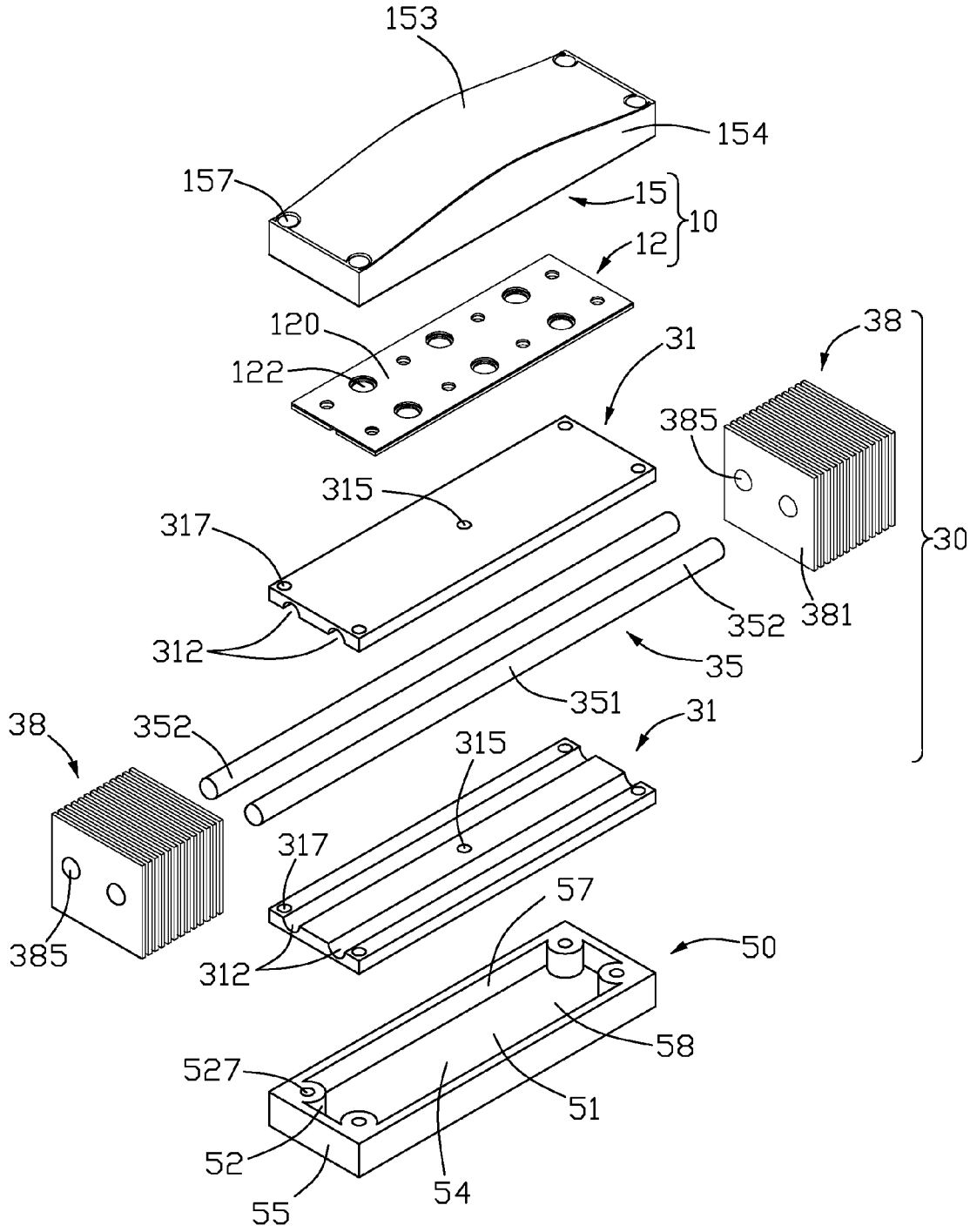
FIG. 2 is an exploded view of FIG. 1.

Please also referring to FIG. 2, the light portion 10 comprises an LED module 12 and a lampshade 15 covering the LED module 12. The LED module 12 comprises a rectangular circuit board 120. The circuit board 120, which can be of rectangular or of other shape. A plurality of evenly spaced LEDs 122 are electrically mounted on a top surface (not labeled) of the circuit board 120. The lampshade 15 is a hollow and rectangular casing comprising a top wall 153 and four lateral walls 154. The top wall 153 is shaped to be an arc surface protruding upwardly. The lampshade 15 is a little bigger than the circuit board 120 and covers the circuit board 120 therein. A transparent material, for example, transparent glass or plastic, can be employed to be a material of a transparent portion of the lampshade 15, such as the top wall 153. A galvanized or silver-gilt material, such as metal or plastic, can be employed to be a reflection portion of the lampshade 15, such as the lateral walls 154. Light generated by the LEDs 122 can be emitted out in a predetermined direction via the lampshade 15. In consideration of conducting the light of the LEDs 122 or appearance of the LED lamp, the lampshade 15 also can be designed to have other shapes. The lampshade 15 further comprises four cylinder portions (not labeled) respectively protruding inwards from four inner corners thereof. Each of the cylinder portions defines a through hole 157 extending in a vertical direction.

The heat dissipation portion 30 comprises two heat spreaders 31 located under the circuit board 120, two straight heat pipes 35 and two heat sinks 38. The two heat spreaders 31 are symmetrically distributed respective to the heat pipes 35. The two heat pipes 35 are partly positioned between the two heat spreaders 31 and partly located at two lateral sides of the heat spreaders 31. The two heat sinks 38 are positioned at the two lateral sides of the heat spreaders 31 and engaged with the two heat pipes 35 respectively.

The heat spreaders 31 are made of metal such as aluminum, copper or alloy and each are of one-piece construction, thus ensuring good thermal conductivity. The heat spreaders 31 both have a similar shape to the circuit board 120 and are a little bigger than the circuit board 120. The circuit board 120 is mounted on an upper heat spreader 31 and contacts with a top surface of the upper heat spreader 31. Each of the heat spreaders 31 defines two straight grooves 312 communicating with the lateral sides thereof. The straight grooves 312 are defined in a surface of each heat spreader 31 facing the heat pipes 35. The two grooves 312 of the two heat spreaders 31 each have a semi-circular cross section. The two grooves 312 of the upper heat spreader 31 cooperate with the grooves 312 of a lower heat spreader 31 to form two circular passages (not labeled) along a longitudinal direction of the heat spreaders 31 for receiving middle portions of the heat pipes 35 therein.

Each of the heat spreaders 31 defines a through hole 315 in a central area thereof in a vertical direction for power wires (not shown) of the circuit board 120 to extend through. Four fixing holes 317 extending in a vertical direction are defined in four corners of the heat spreaders 31 respectively.

The two heat pipes 35 are parallel to each other and are located in a horizontal direction that is parallel to the top surface of the upper heat spreader 31. A length of each heat pipe 35 is longer than a longitudinal length of each of the heat spreaders 31. Each of the heat pipes 35 comprises an evaporating portion 351 received in the circular passage formed by the grooves 312 of the two heat spreaders 31 and two condensing portions 352 extending out from the two lateral sides of the heat spreaders 31 respectively. Thermal grease can be applied to peripheries of the heat pipes 35 or the grooves 312 so that the heat pipes 35 can intimately contact with the heat spreaders 31 to improve heat transfer efficiency of the heat dissipation portion 30. The condensing portions 352 are used to extend outwardly from the two lateral sides of the heat spreaders 31 in the longitudinal direction. The heat pipes 35, which are straight in the shown embodiment, can also be of other shapes including bent, curved, L shape or U shape. The heat pipes 35 can also be replaced by other heat-conducting components having good thermal conductivity and ease of assembly, such as vapor chambers, copper bars or aluminum bars.

The two heat sinks 38 each comprise a plurality of rectangular fins 381 stacked together. The fins 381 can be soldered or fastened to each other. Each of the heat sinks 38 defines two fixing holes 385 corresponding to the heat pipes 35. The fixing holes 385 are used for receiving the condensing portions 352 of the heat pipes 35 so that the heat sinks 38 engage with the heat pipes 35 intimately and are positioned at the lateral sides of the heat spreaders 31. The heat sinks 38 can also be formed by extruding a piece of aluminum. The shape of the heat sink 38 can be rectangular and can also be circular or other shapes, which define holes or grooves for engagingly receiving the condensing portions 352 of the heat pipes 35 therein. The heat sinks 38 should preferably be oriented in a horizontal direction so that the heat sinks 38 can be positioned in the lateral sides of the heat spreaders 31.

The support portion 50 is positioned under the lower heat spreader 31. The support portion 50 comprises a box-shaped body 57. The box-shaped body 57 has a bottom board 54 and four lateral walls 55 which cooperatively form a half-closed room 58 and an opening 51 facing towards the lower heat spreader 31. The half-closed room 58 can be used for receiving a rectifier (not shown) therein. The rectifier is used for converting alternating current to direct current. The power wires of the circuit board 120 is extended through the through holes 315 of the heat spreaders 31 to electrically connect with the rectifier. Thus, the LED module 12 can be powered by the rectifier. The rectifier can also be secured to structures outside of the LED lamp, for example a ceiling or a wall to which the LED lamp is fixed in or connected with. Four columns 52 extend inwardly from four corners of the body 57 respectively. The columns 52 can be used for supporting the lower heat spreader 31. Each of the columns 52 defines a fixing hole 527 corresponding to the fixing hole 317 of the heat spreaders 31. The heat spreaders 31 and the support portion 50 can also be formed integrally or be replaced by a base (not shown). A top portion of the base is adapted for supporting the circuit board 120. The base comprises a solid upper portion defining two horizontal holes therethrough for receiving heat pipes 35. The base comprises a hollow lower portion which can receive the rectifier or connect with the rectifier.

Figure 3:
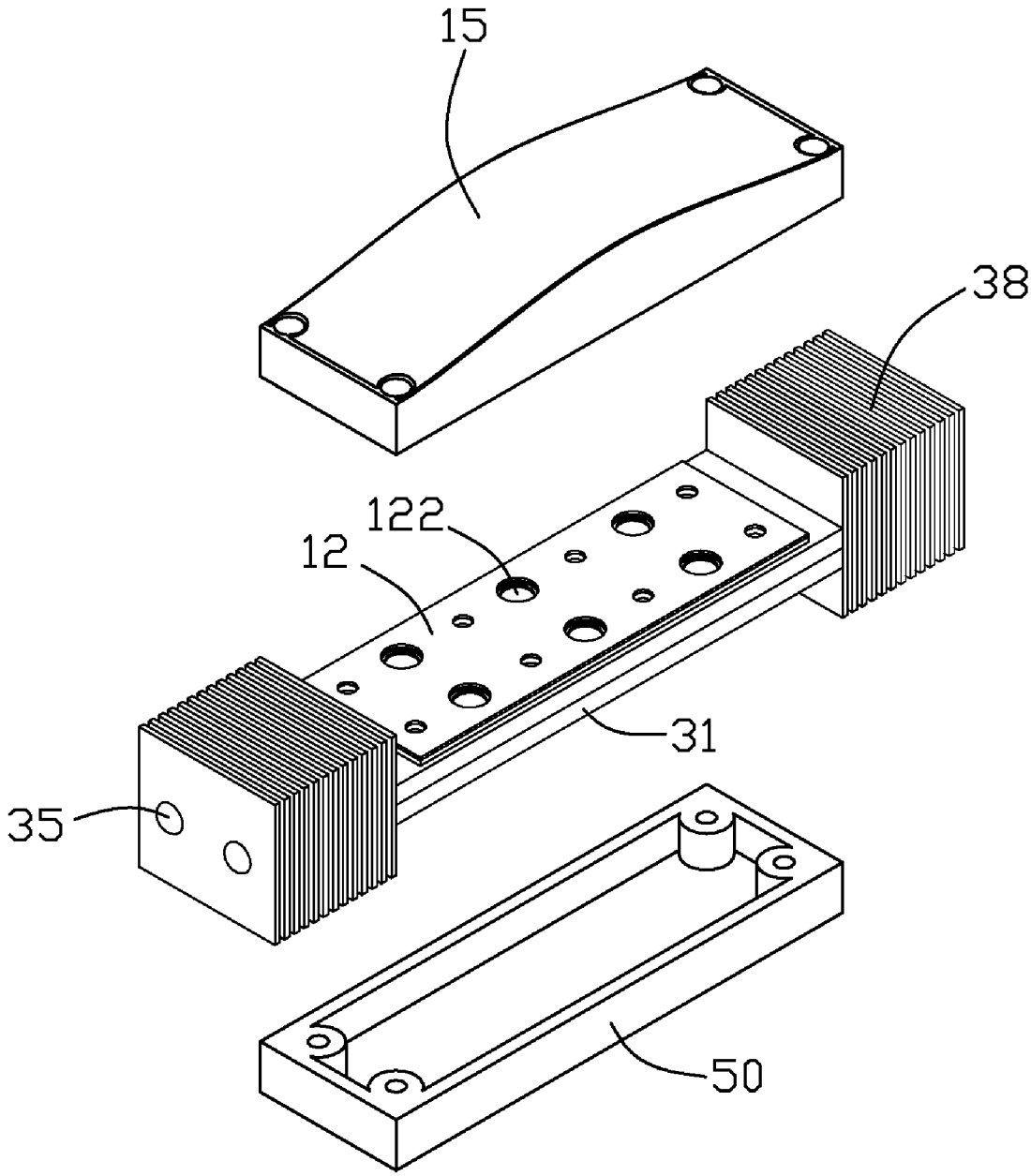
FIG. 3 is a partly exploded view of FIG. 1.

Referring to FIG. 3, in assembly, firstly the evaporating portions 351 of the two heat pipes 35 are accommodated in the grooves 312 of the lower heat spreader 31 in a manner such that each of the heat pipes 35 has an arced surface being in thermal contact with the lower heat spreader 31. Then the upper heat spreader 31 covers the heat pipes 35, thus aligning the grooves 312 of the upper heat spreader 31 with the evaporating portions 351. Thus, the grooves 312 of the two heat spreaders 31 cooperatively form the circular passages for intimately receiving the evaporating portions 351 of the two heat pipes 35. Meanwhile, two opposite plane surfaces of the two heat spreaders 31 contact with each other intimately.

Secondly, the circuit board 120 is mounted on the upper heat spreader 31 with the lampshade 15 covering the LED module 12. The through holes 157 of the lampshade 15, the fixing holes 317 of the heat spreaders 31 and the fixing holes 527 of the support portion 50 align with each other. Four screws (not shown) extend through the through holes 157 and the fixing holes 317 and are screwed in the fixing holes 527.

Thirdly, the condensing portions 352 of the heat pipes 35 are inserted into the fixing holes 385 of the heat sinks 38 and intimately soldered to the heat sinks 38. Meanwhile, the two heat sinks 38 are also positioned in lateral sides of the light portion 10 and the support portion 50, respectively. It is noted that, the LED lamp can be assembled by other means, not limited to the method described above.

In use, when the LEDs 122 are lit, heat generated by the LEDs 122 is firstly absorbed by the heat spreaders 31 via the circuit board 120. Then the heat is conveyed to the evaporating portions 351 of the heat pipes 35, and then quickly conducted to the condensing portions 352 of the heat pipes 35. Then the heat from the condensing portions 352 is transferred to the heat sinks 38 and dispersed to ambient air via the fins 381. The fins 381 can beneficially have a larger area contacting with the ambient air to improve heat dissipation efficiency of the heat sinks 38.

In the LED lamp in accordance with the present invention, the heat sinks 38 are positioned at the lateral sides of the light portion 10 so vertical length of the LED lamp can be reduced greatly. Thus the LED lamp has a thin construction and can easily be secured to different structures, such as ceilings or walls, especially where space for securing the LED lamp is limited. Moreover, the light portion 10 of the LED lamp in accordance with the present invention can be flexibly designed to have more complicated shapes. Furthermore, in applications whereby the LED lamp is hung, ambient air around the LED lamp is heated and becomes hot air. As hot air has a less density than that of cool air below, the hot air flows upwardly away from the heat sinks 37, then cool air below the LED lamp flows upwardly and surrounds the LED lamp in a natural convection manner. Thus heat dissipation efficiency of the LED lamp can be further improved.

What is claimed is:

1. An LED (light emitting diode) lamp comprising:

an LED module comprising a circuit board and a plurality of LEDs electrically mounted on a top surface of the circuit board;

a plurality of heat spreaders positioned on a bottom surface of the circuit board opposite to the top surface thereof;

a heat pipe comprising an evaporating portion received among the heat spreaders and two condensing portions extending from two opposite ends of the evaporating portion to lateral sides of the heat spreaders;

a plurality of heat sinks positioned beside the heat spreaders and engaged with the heat pipe; and a support portion positioned under the heat spreaders, the LED module and the heat spreaders being secured to the support portion;

wherein the evaporating portion of the heat pipe extends through and thermally connects with the heat spreaders and the two condensing portions of the heat pipe thermally connect with the heat sinks;

wherein the support portion comprises a box-shaped body, the box-shaped body comprises a bottom board and four lateral walls and defines an opening facing towards the heat spreaders; and wherein the support portion further comprises four columns extending inwardly from four corners of the four lateral walls thereof, each of the four columns defining a fixing hole corresponding to a hole defined in the plurality of heat spreaders.

2. The LED lamp as claimed in claim 1, wherein the number of the heat spreaders is two, and the evaporating portion of the heat pipe is sandwiched between the two heat spreaders.

3. The LED lamp as claimed in claim 2, wherein each of the heat spreaders defines a groove receiving the evaporating portion of the heat pipe therein.

4. The LED lamp as claimed in claim 1, wherein the heat spreaders are made of metal.

5. The LED lamp as claimed in claim 1, wherein the heat sinks each comprise a plurality of fins stacked together, the two condensing portions of the heat pipe each extending through all of the plurality of fins of a corresponding heat sink.

6. The LED lamp as claimed in claim 1, wherein each of the heat spreaders defines a through hole therein for wires to extend therethrough to electrically connect the LED module with a power source.

* * * * *